US005952982A

United States Patent [19]

Jorgenson et al.

[11] Patent Number: 5,952,982

[45] Date of Patent: Sep. 14, 1999

[54] BROADBAND CIRCULARLY POLARIZED ANTENNA

[75] Inventors: David C. Jorgenson, Palm Bay; Bing Chiang, Melbourne, both of Fla.

[73] Assignee: Harris Corporation, Melbourne, Fla.

[21] Appl. No.: 08/941,837

[22] Filed: Oct. 1, 1997

[51] Int. Cl.[6] ..... H01R 11/10

[52] U.S. Cl. ..... 343/792.5; 343/797

[58] Field of Search ..... 343/792.5, 795, 343/797, 846, 853, 859

[56] References Cited

U.S. PATENT DOCUMENTS

| | | | |
|---|---|---|---|
| 4,054,886 | 10/1977 | Bergander et al. | 343/792.5 |
| 4,594,595 | 6/1986 | Struckman | 343/792.5 |
| 4,605,931 | 8/1986 | Mead et al. | 343/700 |
| 4,608,572 | 8/1986 | Blakney et al. | 343/792.5 |
| 4,658,262 | 4/1987 | DuHamel | 343/792.5 |
| 4,772,891 | 9/1988 | Svy | 343/792.5 |
| 4,785,307 | 11/1988 | Kuo | 343/792.5 |
| 5,068,671 | 11/1991 | Wicks et al. | 343/799 |
| 5,093,670 | 3/1992 | Braathen | 343/792.5 |
| 5,122,809 | 6/1992 | Haruyama et al. | 343/797 |
| 5,132,698 | 7/1992 | Swineford | 343/846 |
| 5,164,738 | 11/1992 | Walter et al. | 343/792.5 |
| 5,212,494 | 5/1993 | Hofer et al. | 343/859 |
| 5,406,292 | 4/1995 | Schnetzer et al. | 343/700 |
| 5,523,767 | 6/1996 | McCorkle | 343/810 |

*Primary Examiner*—Don Wong
*Assistant Examiner*—Tan Ho
*Attorney, Agent, or Firm*—Charles E. Wands

[57] ABSTRACT

A wideband circularly polarized antenna comprises a crossed-element spatial quadrature arrangement of log-periodic antenna elements. The orientation of one of the antenna arms of each diametrically opposed pair of arms is reversed from four port rose configuration, so that the antenna arms of each of the two pairs of elements have mutual mirror symmetry. As a result, each pair of antennal arms may be fed by phase quadrature ports of the same ninety degree hybrid, thereby significantly reducing the complexity of the feed network.

23 Claims, 3 Drawing Sheets

BROADBAND CIRCULARLY POLARIZED ANTENNA

FIELD OF THE INVENTION

The present invention relates in general to broadband antennas, and is particularly directed to a new and improved crossed-element circularly polarized antenna having a spatially quadrature arrangement of log-periodic antenna elements, diametrically opposed ones of which have mutual mirror symmetry and are fed by phase quadrature ports of a ninety degree hybrid.

BACKGROUND OF THE INVENTION

Conventional designs of broadband circularly polarized antennas (those having a bandwidth of several octaves or more) include Vivaldi horns, spiral antennas and log-periodic configurations. Shortcomings of Vivaldi horns include their inability to maintain the same beam shape at edges of the operational band, and the fact that they require very tight manufacturing tolerances; broadband spiral antennas are incapable of dual circular polarization. Although conventional log-periodic arrangements, such as the four-port rose configuration diagrammatically illustrated at 10 in FIG. 1, are capable of dual circular polarization, still, like horn and spiral configurations, they employ a two-tiered feed arrangement.

In order that the respective antenna arms 11–14 may be fed in phase quadrature necessary for circular polarization, such a two-tiered feed customarily includes a ninety degree hybrid 20 coupled in cascade to a phase reversal unit 30 containing of pair of 180° feeds 31 and 32. Because two tiers of phase feed involve substantial insertion loss and cost, it is desirable to simplify this conventional feed hardware configuration, without compromising the performance or functional capability of the antenna.

SUMMARY OF THE INVENTION

In accordance with the present invention, this objective is successfully addressed a crossed-element circularly polarized antenna comprised of a spatially quadrature arrangement of log-periodic antenna elements, in which the orientation of one of the antenna arms of each diametrically opposed pair of arms is reversed from a conventional configuration. More particularly, the broadband circularly polarized antenna in accordance with the present invention comprises four log-periodic antenna elements that are distributed around a boresight center point in spatial quadrature, so as form a four arm rose pattern, having its respective elements sequentially spatially located at 0°, 90°, 180° and 270° relative directions. Because the orientation of one of the antenna arms of each diametrically opposed pair of arms is reversed from the configuration of FIG. 1, the diametrically opposed arms of each of the two pairs elements have mutual mirror symmetry, so that pairs of antennal arms may be fed by phase quadrature ports of a single ninety degree hybrid.

A first port of the 90° hybrid is coupled in common to the diametrically opposed pair of mutually symmetric log-periodic (0°) antenna elements, which a second (90°) port is coupled in common to the other diametrically opposed pair of log-periodic antenna elements. In a practical implementation, the 90° curvilinear log-periodic microstrip configured antenna arms are distributed as respectively offset arc segments, extending from opposite end portions of a first continuous section of microstrip. To maintain a constant impedance, this microstrip section is tapered outwardly in the radial direction from a center feed point. The center feed point is coupled to the 90° port of the hybrid feed, so that each antenna arm is fed in common.

Similarly, the diametrically opposed, 0° curvilinear log-periodic microstrip configured antenna arms are distributed as respectively offset arc segments, extending from opposite end portions of respective spaced apart microstrip sections, that are tapered outwardly in the radial direction to maintain a constant impedance. These radially tapered microstrip sections have second end portions adjacent to the center feed point of the linearly tapered microstrip section, and are interconnected by a cross-under feed.

In order to maintain a constant impedance between each of the 0° antenna elements and a feed point to the 0° port of the 90° hybrid 50, the cross-under feed has a non-linear geometrical configuration, such as a serpentine geometrical configuration, comprised of sequentially contiguous, semicircularly shaped sections of microstrip having respectively different radii. The cross-under feed may include a pair of semicircularly shaped sections of microstrip centered along a centerline of the antenna elements. This centerline is orthogonal to a line about which the second diametrically opposed pair of 90° antenna elements have mutually relative mirror symmetry. The semicircularly shaped microstrip section may be replaced by a pair of reduced radii semicircularly shaped microstrip sections centered along the centerline.

To implement the microstrip feed geometry on a planar printed circuit board, the serpentine feed formed of semicircularly shaped microstrip sections intersects a plated through-hole, which serves as the 0° feed point and is located along a 45° line that bisects the spatial quadrature directions of the two antenna pairs. The first semicircular microstrip section is formed on the same side of the printed circuit board on which the linearly tapered microstrip section of the 90° antenna pair is formed. The first semicircular microstrip section extends to and is contiguous with the near end of one of the linearly tapered microstrip sections.

A first segment of the semicircular microstrip section extends from the first semicircular microstrip section to the plated through-hole. A second segment of the semicircular microstrip section extends on a second side of the printed circuit board to a further plated through-hole that terminates the near end of another linearly tapered microstrip section on the first side of the printed circuit board. The second segment of the semicircular microstrip section provides a cross-under beneath the linearly tapered microstrip section.

A conical groundplane is concentric with the antenna boresight and has a constant quarter wavelength spacing from the spatially quadrature distribution of log-periodic antenna elements. The conical groundplane causes energy to be reflected back through the excited antenna element along the intended direction of radiation, reinforcing the energy propagating directly from the antenna element and, improving peak gain.

DETAILED DESCRIPTION

Figure 2:
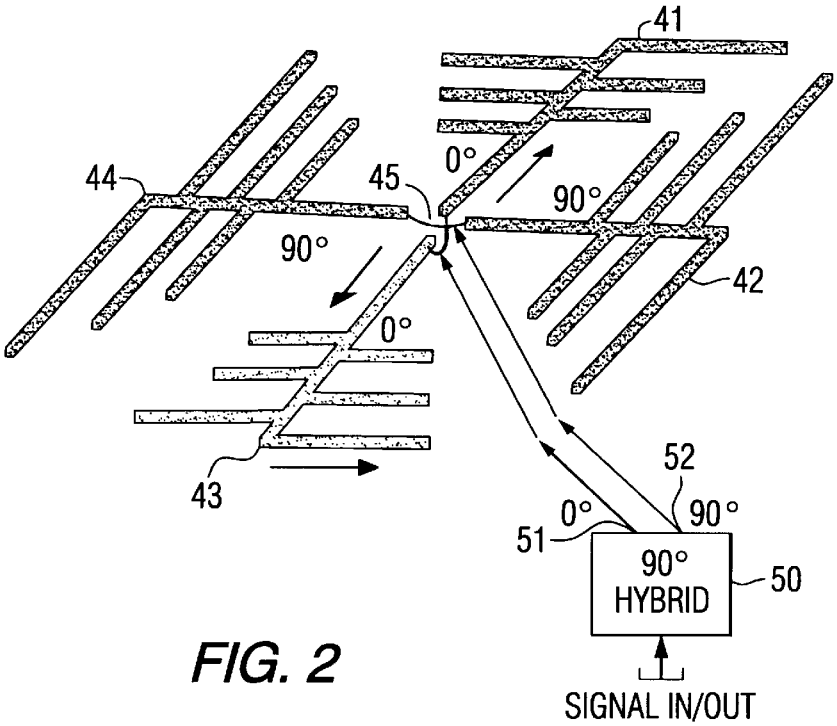
FIG. 2 diagrammatically illustrates a four-port rose antenna in accordance with the invention, in which the spatial orientation of one of the arms of each of the diametrically opposed arms of the configuration of FIG. 1 is reversed, so that the antenna may be fed by only a single ninety degree hybrid.

A broadband circularly polarized antenna in accordance with the present invention is diagrammatically illustrated in FIG. 2 as comprising a plurality of log-periodic antenna elements 41, 42, 43 and 44, respectively distributed around a boresight center point 45 in spatial quadrature, so as form a four arm rose pattern, having its respective elements sequentially spatially located at 0°, 90°, 180° and 270° relative directions.

Figure 1:
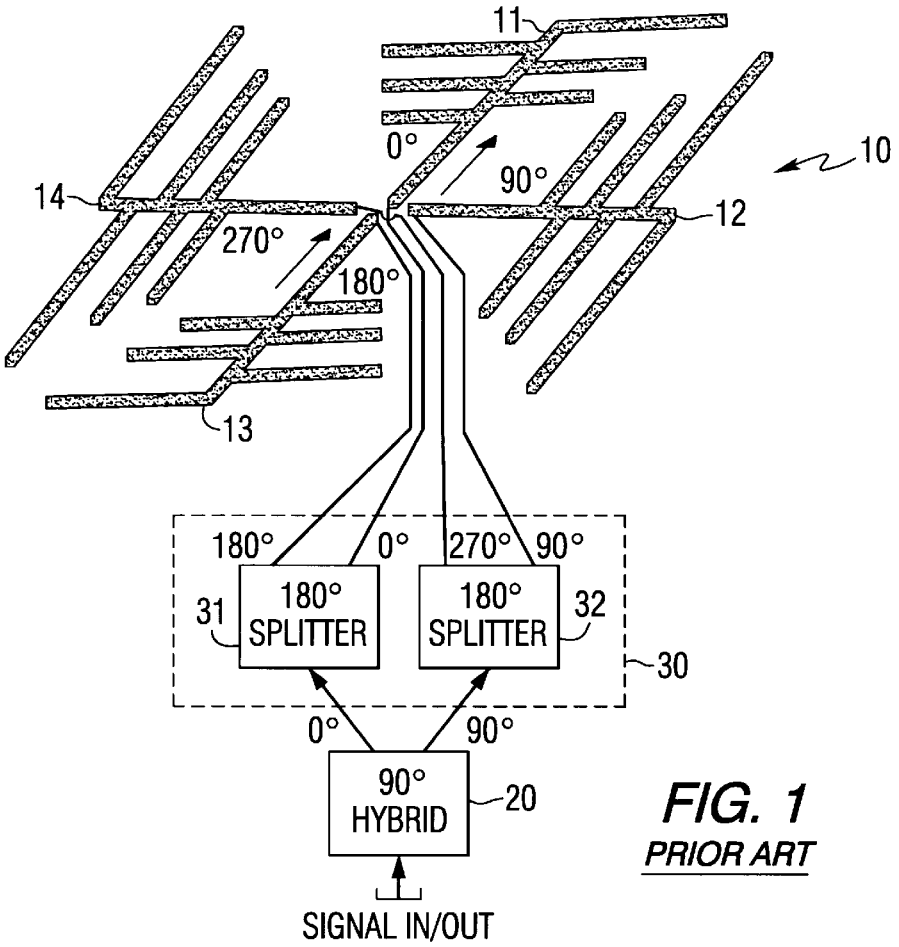
FIG. 1 PRIOR ART
FIG. 1 diagrammatically illustrates a conventional four-port rose antenna of log-periodic configured antenna arms opposite phase ports of which are coupled to a two-tiered feed.

From a comparison of FIGS. 1 and 2, it can be seen that the configuration of FIG. 2 has antenna arm 43 oriented opposite to or 'flipped' 180° relative to antenna arm 13 of the conventional configuration of FIG. 1. Likewise, antenna arm 44 is flipped 180° relative to antenna arm 14 of the conventional configuration of FIG. 1. As a result, for the pair of diametrically opposed antenna arms 41 and 43, antenna 43 has mutual mirror symmetry with respect to antenna 41, so that both of these antenna arms are 0° arms. For the pair of diametrically opposed antenna arms 42 and 44 (which are oriented in spatial quadrature with respect to 0° arms 41 and 43), antenna 44 has mutual mirror symmetry with respect to antenna 42, so that both of these antenna arms are 90° arms.

As pointed out above, this dual mutual mirror symmetry of the configuration of FIG. 2 allows the use of a signal interface, shown at 50 as a 90° hybrid, having phase quadrature (0° and 90°) ports 51 and 52. A first port 51 of 90° hybrid 50 is coupled in common to the diametrically opposed pair of mutually symmetric log-periodic (0°) antenna elements 41 and 43. A second (90°) port 52 is coupled in common to the other diametrically opposed pair of said log-periodic antenna elements 42 and 44, (distributed in spatial quadrature to antenna elements 41 and 43).

Figure 3:
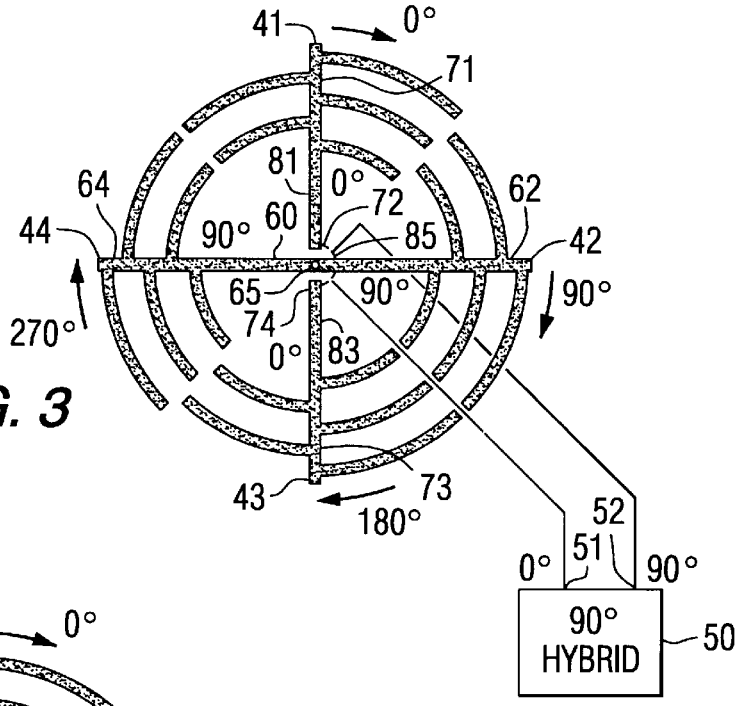
FIG. 3 diagrammatically illustrates a four-port rose antenna of FIG. 3 configured as curvilinear log-periodic microstrip antenna arms.

For this purpose, as shown in the diagram of FIG. 3, diametrically opposed, 90° curvilinear log-periodic microstrip configured antenna arms 42 and 44 are distributed as respectively offset arc segments, extending from opposite end portions 62 and 64 of a first continuous section of microstrip 60. As will be described below with reference to FIGS. 4 and 5, the section of microstrip is tapered outwardly in the radial direction from its center feed point 65, in order to maintain a constant impedance.

The center feed point 5 of the microstrip section 60 is coupled to the 90° port 52 of the hybrid 50, so that each antenna arm 42 and 44 is fed in common. Similarly, diametrically opposed, 0° curvilinear log-periodic microstrip configured antenna arms 41 and 43 are distributed as respectively offset arc segments, extending from opposite end portions 71 and 73 of respective first and second spaced apart linearly tapered, radially extending microstrip sections 81 and 83. The tapered microstrip sections 81 and 83 have second, narrow end portions 72 and 74 thereof adjacent to the center feed point 65 linearly tapered microstrip section 60, which are interconnected by a cross-under feed 85 therebetween.

Figure 4:
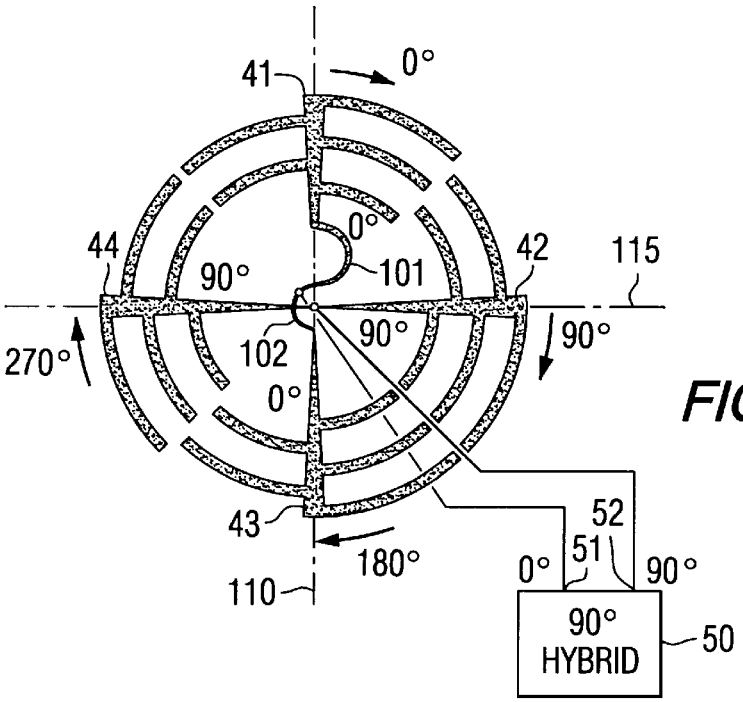
FIG. 4 shows a two segment geometry of a semicircular cross-under feed.
Figure 5:
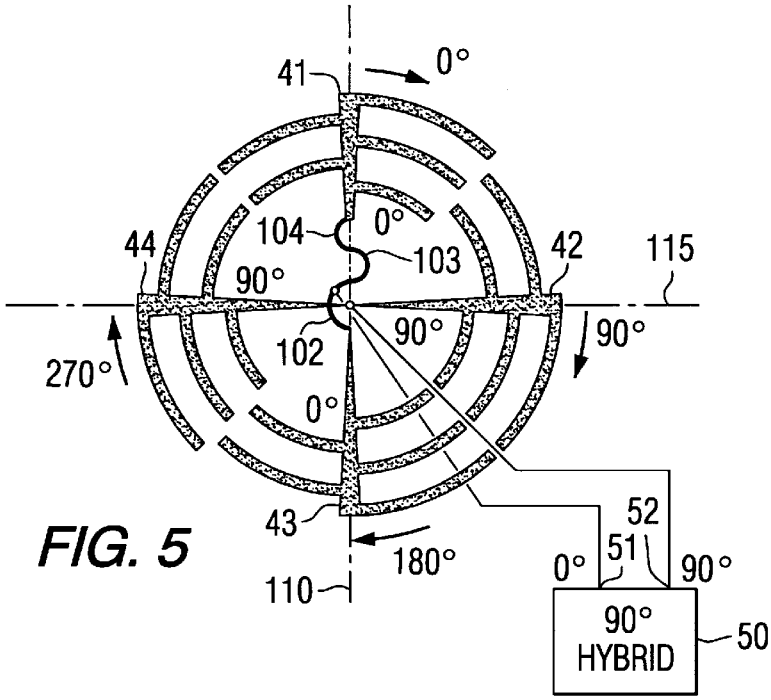
FIG. 5 shows a three segment geometry of a semicircular cross-under feed.

In order to maintain a constant impedance between each of the antenna elements 41 and 43 and a feed point 91 to the port 51 of the 90° hybrid 50, the cross-under feed 85 may have a non-linear geometrical configuration, such as a serpentine geometrical configuration comprised of sequentially contiguous, semicircularly shaped sections of microstrip having respectively different radii, as diagrammatically illustrated in FIGS. 4 and 5.

In the geometry of FIG. 4, the cross-under feed 85 is shown as comprised of a pair of semicircularly shaped sections of microstrip 101 and 102 centered along a centerline 110 of the diametrically opposed pair of antenna elements 41 and 43. As noted above, the widths of those portions of the antenna elements 41–44 that extend radially from their feed points, are tapered with increasing widths radially outwardly, as shown in FIGS. 4 and 5, so as to maintain a constant impedance. In addition, the width of microstrip section 101 varies along its length, in order to maintain a constant impedance.

The centerline 110 is orthogonal to a line 115 about which the second diametrically opposed pair of antenna elements 42 and 44 have mutually relative mirror symmetry. In the geometry of FIG. 5, the semicircularly shaped microstrip section 101 of FIG. 4 is replaced by a pair of reduced radii semicircularly shaped microstrip sections 103 and 104, centered along a centerline 110 of the diametrically opposed pair of antenna elements 41 and 43.

Figure 6:
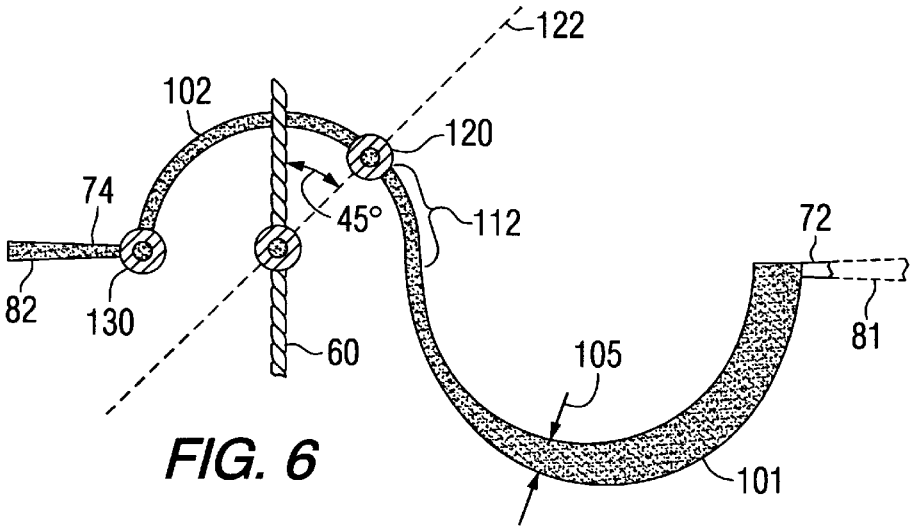
FIGS. 6 and 7 show the details of a microstrip architecture for implementing the feed geometry of FIG. 4.
Figure 7:
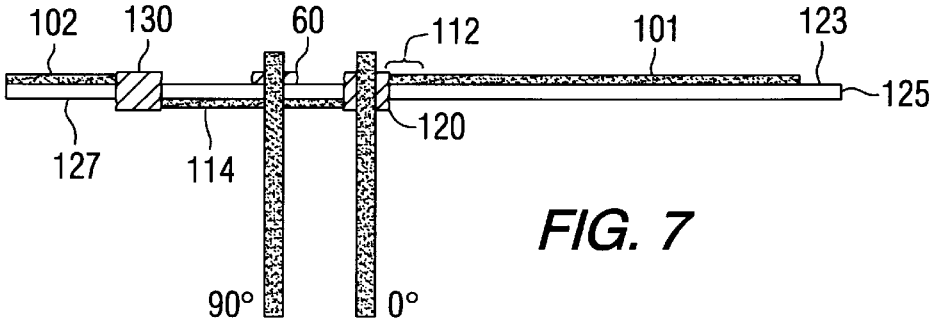

FIGS. 6 and 7 show the details of a microstrip architecture for implementing the feed geometry of FIG. 4, wherein the serpentine feed formed of semicircularly shaped microstrip sections 101 and 102 intersects a plated through-hole 120 of a printed circuit 9 (insulated) board 125. Plated through hole 120 serves as the 0° feed point for antenna arms 41 and 43, and is located along a 45° line 122 that bisects the spatial quadrature directions of the two antenna pairs 41–43 and 42–44.

The entirety of the first semicircular microstrip section 101, shown as having a constant impedance-maintaining varying width 105, is disposed on a first side 123 of printed circuit board 125, upon which the linearly tapered microstrip section 60 is formed. The first semicircular microstrip section 101 extends to and is contiguous with the near end 72 of linearly tapered microstrip section 81. A first segment 112 of the semicircular microstrip section 102 extends from the first semicircular microstrip section 101 to the plated through-hole 120. A second segment 114 of the semicircular microstrip section 102 extends on a second side 127 of the printed circuit board 125, from the plated through-hole 120 to a further plated through-hole 130, that terminates the near end 74 of linearly tapered microstrip section 82 on the first side 123 of the printed circuit board 125. This second segment 114 of the semicircular microstrip section 102 serves to provide a bridge or cross-under beneath the linearly tapered microstrip section 60.

Figure 8:
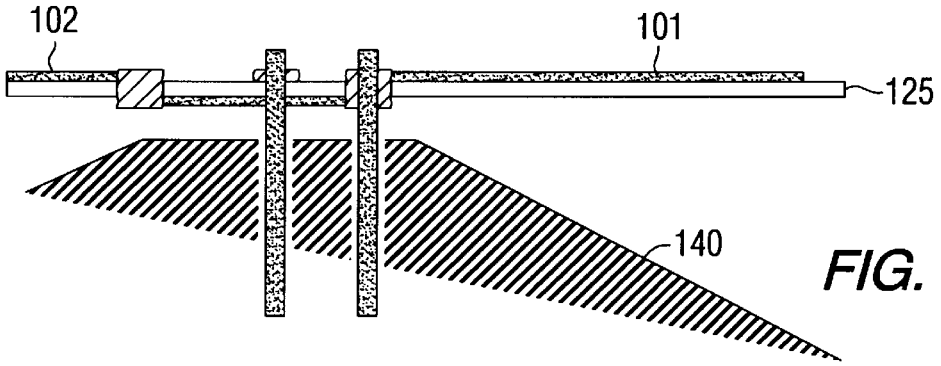
FIG. 8 diagrammatically illustrates a conical groundplane that is concentric with the antenna boresight and has a constant quarter wavelength spacing from the spatially quadrature distribution of log-periodic antenna elements of FIG. 7.

FIG. 8 diagrammatically illustrates a conical groundplane 140, that is concentric with the antenna boresight and has a constant quarter wavelength spacing from the spatially quadrature distribution of log-periodic antenna elements 41–44 of FIG. 7. Conical groundplane 140 serves to cause energy to be reflected back through the excited antenna element along the intended direction of radiation, reinforcing the energy propagating directly from the antenna element and thereby improves peak gain.

As will be appreciated from the foregoing description, the desired to simplify the conventional feed hardware configuration of a wideband circularly polarized antenna, without compromising its performance or functional capability, is successfully addressed by a spatially quadrature arrangement of log-periodic antenna elements, in which the orientation of one of the antenna arms of each diametrically opposed pair of arms is reversed from a conventional configuration. What results is an antenna configuration in which antenna arms of each of the two pairs elements have mutual mirror symmetry, so that pairs of antennal arms may be fed by phase quadrature ports of a only single ninety degree hybrid.

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein, but intend to cover all such changes and modifications as are obvious to one of ordinary skill in the art.

What is claimed:

1. A crossed-element antenna comprising:

a spatially quadrature distribution of four antenna elements, each of which has the same two dimensional geometrical configuration, and wherein diametrically opposed ones of a first diametrically opposed pair of said four antenna elements are spatially orthogonal to diametrically opposed ones of a second diametrically opposed pair of said four antenna elements, have mutually relative mirror symmetry and are coupled to a first phase port of a signal interface, and wherein said diametrically opposed ones of said second diametrically opposed pair of said four antenna elements have mutually mirror symmetry and are coupled to a second phase port of said signal interface; and the signal interface having phase quadrature ports, one of which is coupled to said first diametrically opposed pair of said antenna elements, and said second of which is coupled to a second diametrically pair of said antenna elements.

2. A crossed-element antenna according to claim 1, wherein said signal interface comprises a ninety degree hybrid.

3. A crossed-element antenna according to claim 1, wherein antenna elements of s aid first diametrically opposed pair of antenna elements are distributed along opposite end portions of a common conductor.

4. A crossed-element antenna according to claim 3, wherein antenna elements of said second diametrically opposed pair of antenna elements are distributed along opposite first end portions of spaced apart conductors having second portions adjacent to said common conductor and being interconnected by a cross-over feed therebetween.

5. A crossed-element antenna according to claim 4, wherein said cross-over feed has a geometrical configuration that maintains a constant impedance between each of the antenna elements of said second diametrically opposed pair of antenna elements and a feed point to said second of said phase quadrature ports of said signal interface.

6. A crossed-element antenna according to claim 5, wherein each of said antenna elements has a log-periodic configuration.

7. A crossed-element antenna according to claim 6, wherein said cross-over feed has a serpentine geometrical configuration.

8. A crossed-element antenna according to claim 7, wherein said serpentine geometrical configuration of said cross-over feed is comprised of a pair of semicircularly shaped sections of microstrip having respectively different radii.

9. A crossed-element antenna according to claim 8, wherein said semicircularly shaped sections of microstrip are centered along a centerline of said second diametrically opposed pair of antenna elements, which have non-uniform widths therealong, to provide a constant impedance.

10. A crossed-element antenna according to claim 8, wherein said semicircularly shaped sections of microstrip are centered along a line orthogonal to a line about which said second diametrically opposed pair of antenna elements have mutually relative mirror symmetry.

11. A crossed-element antenna according to claim 4, wherein said ninety degree hybrid has a ninety degree port coupled to said first diametrically opposed pair of said antenna elements, and a zero degree port coupled to said second diametrically pair of said antenna elements.

12. A crossed-element antenna according to claim 1, further including a conical groundplane disposed adjacent to said spatially quadrature distribution of antenna elements.

13. A crossed-element antenna according to claim 1, wherein feed points of said first and second diametrically opposed pairs of antenna elements are located on a line about which said first pair of antenna elements is symmetrical with respect to said second pair of antenna elements.

14. A crossed-element antenna according to claim 1, wherein each of said antenna elements has a log-periodic configuration.

15. A broadband circularly polarized antenna comprising:

a spatially quadrature distribution of four log-periodic antenna elements, diametrically opposed ones of a first diametrically opposed pair of which have mutual mirror symmetry and are spatially orthogonal to diametrically opposed ones of a second diametrically opposed pair of said four log-periodic antenna elements which have mutual mirror symmetry; and a signal interface having phase quadrature ports, one of which is coupled in common to said first diametrically opposed pair of said log-periodic antenna elements, and a second of which is coupled in common to said second diametrically opposed pair of said log-periodic antenna elements.

16. A broadband circularly polarized antenna according to claim 15, wherein said signal interface comprises a ninety degree hybrid.

17. A broadband circularly polarized antenna according to claim 16, wherein said ninety degree hybrid has a ninety degree port coupled to said first diametrically opposed pair of said antenna elements, and a zero degree port coupled to said second diametrically pair of said antenna elements.

18. A broadband circularly polarized antenna according to claim 15, wherein antenna elements of said first diametrically opposed pair are distributed along opposite end portions of a first conductor having a first feed point coupled to a first port of said signal interface, and wherein antenna elements of said second diametrically opposed pair are distributed along opposite first end portions of second and third spaced apart conductors having second portions thereof adjacent to said common conductor, and being interconnected by a cross-over feed therebetween having a non-linear geometrical configuration that maintains a constant impedance between each of the antenna elements of said second diametrically opposed pair, and a feed point to a second port of said signal interface.

19. A broadband circularly polarized antenna according to claim 18, wherein said cross-over feed has a serpentine geometrical configuration is comprised of a pair of semicircularly shaped sections of microstrip having respectively different radii.

20. A broadband circularly polarized antenna according to claim 19, wherein said semicircularly shaped sections of microstrip are centered along a centerline of said second diametrically opposed pair of antenna elements, which have non-uniform widths to provide a constant impedance therealong.

21. A broadband circularly polarized antenna according to claim 19, wherein said semicircularly shaped sections of microstrip are centered along a line orthogonal to a line about which said second diametrically opposed pair of antenna elements have mutually relative mirror symmetry.

22. A broadband circularly polarized antenna according to claim 15, further including a conical groundplane adjacent to said spatially quadrature distribution of log-periodic antenna elements.

23. A broadband circularly polarized antenna according to claim 15, wherein feed points of said first and second diametrically opposed pairs of antenna elements are located on a line about which said first pair of antenna elements is symmetrical with respect to said second pair of antenna elements.

* * * * *